US007625077B2

(12) United States Patent
Shinada et al.

(10) Patent No.: US 7,625,077 B2
(45) Date of Patent: Dec. 1, 2009

(54) LIQUID CARTRIDGE, LIQUID EJECTION APPARATUS AND LIQUID EJECTION CONTROL METHOD

(75) Inventors: Satoshi Shinada, Nagano (JP); Taku Ishizawa, Nagano (JP); Kazuhiro Nakamura, Nagano (JP); Masayoshi Katayama, Nagano (JP); Toshiro Shimaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 526 days.

(21) Appl. No.: 11/382,809

(22) Filed: May 11, 2006

(65) Prior Publication Data

US 2006/0268077 A1 Nov. 30, 2006

(30) Foreign Application Priority Data

May 12, 2005 (JP) ..... P2005-140133
Feb. 17, 2006 (JP) ..... P2006-041288

(51) Int. Cl.
*B41J 2/175* (2006.01)

(52) U.S. Cl. ..... 347/84

(58) Field of Classification Search ..... 347/7, 347/19, 85, 86, 87; 141/2, 18
See application file for complete search history.

(56) References Cited

U.S. PATENT DOCUMENTS 4,437,104 A * 3/1984 Hudson ..... 347/86
6,582,068 B2 * 6/2003 Ishizawa et al. ..... 347/85
6,848,776 B2 * 2/2005 Nishioka et al. ..... 347/86
7,404,628 B2 * 7/2008 Naka et al. ..... 347/86
2005/0243110 A1 11/2005 Takahashi et al.

FOREIGN PATENT DOCUMENTS

| | | | |
|---|---|---|---|
| DE | 10 2005 018034 | A1 | 12/2005 |
| GB | 2 321 220 | A | 7/1998 |
| GB | 2 413 385 | A | 10/2005 |
| JP | 08-034123 | A | 2/1996 |
| JP | 2003-39694 | A | 2/2003 |

* cited by examiner

*Primary Examiner*—Anh T. N. Vo
(74) *Attorney, Agent, or Firm*—Stroock & Stroock & Lavan LLP

(57) ABSTRACT

An ink cartridge 1 attachable to an ink jet printer, includes a liquid chamber 5 for accommodating an ink liquid 4, a liquid supply port 7 to be connected to a liquid receiving portion 2*a* on the ink jet printer side, a liquid passage 9 for causing the liquid chamber 5 to communicate with the liquid supply port 7, and an ink end sensor 13 forming a part of the liquid passage 9 and serving to detect a presence or absence of the ink liquid 4 in the liquid chamber 5, The liquid passage 9 on a downstream of the ink end sensor 13 is provided with a buffer chamber 15 capable of storing the ink liquid 4 to be supplied to the liquid supply port 7 and supplying the ink liquid in a constant amount after the ink end sensor 13 detects that the liquid is not present. An amount of storage of the liquid in the buffer chamber 15 is set to be substantially 10% of an effective amount of the ink liquid to be accommodated in the liquid cartridge 1.

5 Claims, 4 Drawing Sheets

LIQUID CARTRIDGE, LIQUID EJECTION APPARATUS AND LIQUID EJECTION CONTROL METHOD

BACKGROUND OF THE INVENTION

1. Technical Field of the Invention

The present invention relates to a liquid cartridge which is suitable for an ink cartridge to be attached to an ink jet printer, for example, and a liquid ejection apparatus to which the liquid cartridge is attachable. Also, the present invention further related to a liquid ejection control method in an apparatus using the liquid cartridge.

2. Description of the Related Art

As an ink cartridge to be attached to an ink jet printer, there has variously been proposed a liquid cartridge comprising, in a container body to be attached to a printer (an apparatus), a liquid chamber for accommodating an ink liquid (a liquid), a liquid supply port to be connected to an ink liquid receiving portion (a liquid receiving portion) on the printer side, a liquid passage for causing the liquid chamber to communicate with the liquid supply port, and an ink end sensor (a liquid end sensor) provided in the middle of the liquid passage and serving to detect the presence of an ink in the liquid chamber (for example, see JP-A-2003-39694 Publication).

On the printer side where such an ink cartridge is used, for example, there is provided a control circuit for monitoring an output of an ink end sensor such as an optical sensor for optically detecting the presence of an ink or an electrical sensor for electrically detecting the presence of the ink and giving a notice of an exchange time for the ink cartridge.

When the ink end sensor provided on the ink cartridge usually detects the absence of the ink liquid, however, the ink liquid remains in the liquid passage between the ink end sensor and the liquid supply port. For this reason, even if the absence of the ink liquid is detected by the ink end sensor, it is wasteful to instantly exchange the ink cartridge since the remaining ink is discarded in a non-use state.

In a related art ink cartridge, however, an amount of an ink remaining in the liquid passage between the ink end sensor and the liquid supply port is not grasped quantitatively. When the absence of the ink liquid is detected by the ink end sensor and is then used carelessly and continuously, therefore, there is a possibility that the ink might run out in the middle of a page to waste a paper or the remaining ink might be used up to damage a printing head due to idle ejecting of the printing head.

SUMMARY OF THE INVENTION

It is an object of the invention to solve the problems and to provide a liquid cartridge, a liquid ejection apparatus and a liquid ejection control method which can minimize an amount of a liquid remaining in the liquid cartridge, and furthermore, can reliably prevent a drawback from being caused by idle ejecting on an apparatus side.

The object is achieved by the following embodiments.

(1). A liquid cartridge mountable to an apparatus, comprising:

a liquid chamber, having a first capacity to store a liquid therein;

a liquid supplying port, connectable to a liquid receiving portion of the apparatus;

a liquid passage, through which the liquid chamber and the liquid supplying port communicate with each other;

a liquid sensor, forming a part of the liquid passage and detecting a presence or absence of the liquid in the liquid chamber; and a buffer chamber, having a second capacity to store the liquid therein and communicating with the liquid passage at a downstream of the liquid sensor, wherein the second capacity is set to be substantially 10% of an effective liquid amount of the liquid cartridge.

According to the liquid cartridge having the structure, it is apparent that the liquid corresponding to substantially 10% of the effective amount of the liquid in the liquid cartridge remains in the buffer chamber provided on the liquid passage at the downstream of the liquid sensor when the absence of the residual liquid is detected by the liquid sensor.

If the liquid ejection processing is executed by the apparatus within an allowable range corresponding to substantially 10% of the effective liquid amount of the liquid cartridge and the liquid cartridge is then exchanged after the absence of the residual liquid is detected by the liquid sensor, therefore, the amount of the liquid remaining in the liquid cartridge to be discarded due to the exchange can be minimized because the liquid in the buffer chamber has already been consumed almost perfectly.

When the absence of the residual liquid is detected by the liquid sensor, moreover, the amount of the liquid remaining in the buffer chamber is clear. Therefore, a subsequent processing can be prevented from being continuously carried out carelessly for a long period of time. Consequently, it is possible to reliably prevent a drawback from being caused by idle ejecting on the apparatus side due to the continuous use in a state in which the amount of the residual liquid in the liquid cartridge is completely nulled.

(2). A liquid cartridge mountable to an apparatus, comprising:

a liquid chamber, having a first capacity to store a liquid therein;

a liquid supplying port, connectable to a liquid receiving portion of the apparatus;

a liquid passage, through which the liquid chamber and the liquid supplying port communicate with each other;

a liquid sensor, forming a part of the liquid passage and detecting a presence or absence of the liquid in the liquid chamber; and a buffer chamber, having a second capacity to store the liquid therein and communicating with the liquid passage at a downstream of the liquid sensor, wherein the second capacity is set to be a standard use amount consumed when the apparatus ejects the liquid to one medium.

According to the liquid cartridge having the structure, it is apparent that the liquid corresponding to the standard use amount in the ejection of the liquid onto the medium by the apparatus remains in the buffer chamber provided on the liquid passage at the downstream side of the liquid sensor when the absence of the residual liquid is detected by the liquid sensor.

Also after the absence of the residual liquid is detected by the liquid sensor, therefore, the apparatus can reliably end the processing of ejecting the liquid onto the medium so that the processing for the medium can be prevented from being ended incompletely.

If the processing of ejecting the liquid onto the medium is executed and the liquid cartridge is then exchanged after the absence of the residual liquid is detected by the liquid sensor, moreover, the amount of the liquid remaining in the liquid cartridge to be discarded due to the exchange can be minimized because the liquid in the buffer chamber has already been consumed almost perfectly.

When the absence of the residual liquid is detected by the liquid sensor, furthermore, the amount of the liquid remaining in the buffer chamber is clear. Therefore, the subsequent processing can be prevented from being continuously carried out carelessly for a long period of time. Consequently, it is possible to reliably prevent a drawback from being caused by idle ejecting on the apparatus side due to the continuous use in a state in which the amount of the residual liquid in the liquid cartridge is completely nulled.

(3). A liquid cartridge mountable to an apparatus, comprising:

a liquid chamber, having a first capacity to store a liquid therein;

a liquid supplying port, connectable to a liquid receiving portion of the apparatus;

a liquid passage, through which the liquid chamber and the liquid supplying port communicate with each other;

a liquid sensor, forming a part of the liquid passage and detecting a presence or absence of the liquid in the liquid chamber; and a buffer chamber, having a second capacity to store the liquid therein and communicating with the liquid passage at a downstream of the liquid sensor, wherein the second capacity is set to be a maximum consumption amount consumed when the apparatus is subjected to a maintenance processing.

According to the liquid cartridge having the structure, it is apparent that the liquid in the amount corresponding to the maximum value of the consumption amount of the liquid consumed in the maintenance processing such as cleaning by the apparatus remains in the buffer chamber provided on the liquid passage at the downstream side of the liquid sensor when the absence of the residual liquid is detected by the liquid sensor.

Therefore, it is possible to reliably execute the cleaning processing in which the consumption amount of the liquid is maximized until the absence of the residual liquid is detected by the liquid sensor.

When the absence of the residual liquid is detected by the liquid sensor, moreover, the amount of the liquid remaining in the buffer chamber is clear. In the case in which the maintenance processing such as the cleaning is not executed, therefore, it is preferable that the residual liquid should be alternatively consumed by the employment of a normal processing corresponding to the amount of the residual liquid and the liquid cartridge should be then exchanged quickly. Consequently, a subsequent processing can be prevented from being continuously carried out carelessly for a long period of time. Thus, it is possible to reliably prevent a drawback from being caused by idle ejecting by the apparatus due to the continuous use in a state in which the amount of the residual liquid in the liquid cartridge is completely nulled.

(4). A liquid cartridge mountable to an apparatus, comprising:

a liquid chamber, having a first capacity to store a liquid therein;

a liquid supplying port, connectable to a liquid receiving portion of the apparatus;

a liquid passage, through which the liquid chamber and the liquid supplying port communicate with each other;

a liquid sensor, forming a part of the liquid passage and detecting a presence or absence of the liquid in the liquid chamber; and a buffer chamber, having a second capacity to store the liquid therein and communicating with the liquid passage at a downstream of the liquid sensor, wherein the second capacity is set to be an initial filling amount for filling the liquid in a passage from the liquid cartridge to a liquid ejection head when the liquid cartridge is attached to the apparatus.

According to the liquid cartridge having the structure, it is apparent that the liquid corresponding to the amount of initial filling in the attachment to the apparatus remains in the buffer chamber provided on the liquid passage at the downstream of the liquid sensor when the absence of the residual liquid is detected by the liquid sensor.

In a state in which the absence of the residual liquid is not detected by the liquid sensor when the liquid cartridge is to be once removed from the apparatus in the middle of the use, accordingly, the amount of the residual liquid in the liquid cartridge can be prevented from being completely nulled so that the initial filling can be executed safely, and at the same time, the generation of the idle ejecting can be prevented even if the initial filling is executed when the liquid cartridge is attached to the apparatus again.

When the absence of the residual liquid is detected by the liquid sensor, moreover, the amount of the liquid remaining in the buffer chamber is clear. In the case in which the initial filling is not carried out, therefore, it is preferable that the residual liquid should be alternatively consumed by the employment of a normal processing corresponding to the amount of the initial filling and the liquid cartridge should be then exchanged quickly. Consequently, the subsequent processing can be prevented from being continuously carried out carelessly for a long period of time. Thus, it is possible to reliably prevent a drawback from being caused by idle ejecting on the apparatus side due to the continuous use in a state in which the amount of the residual liquid in the liquid cartridge is completely nulled.

(5). A liquid cartridge mountable to an apparatus, comprising:

a liquid chamber, having a first capacity to store a liquid therein;

a liquid supplying port, connectable to a liquid receiving portion of the apparatus;

a liquid passage, through which the liquid chamber and the liquid supplying port communicate with each other;

a liquid sensor, forming a part of the liquid passage and detecting a presence or absence of the liquid in the liquid chamber; and a buffer chamber, having a second capacity to store the liquid therein and communicating with the liquid passage at a downstream of the liquid sensor, wherein the second capacity is set to be a reference amount for prohibiting a maintenance processing.

According to the liquid cartridge having the structure, it is apparent that the liquid corresponding to the amount of the residual liquid in the liquid chamber to be the reference amount for prohibiting the maintenance processing such as the cleaning by the apparatus remains in the buffer chamber provided on the downstream of the liquid sensor when the absence of the residual liquid is detected by the liquid sensor.

Therefore, it is possible to reliably execute the maintenance processing such as the cleaning until the absence of the residual liquid is detected by the liquid sensor.

When the absence of the residual liquid is detected by the liquid sensor, moreover, the amount of the liquid remaining in the buffer chamber is clear. In the case in which the maintenance processing such as the cleaning is not executed, therefore, it is preferable that the residual liquid should be alternatively consumed by the employment of a normal processing corresponding to the amount of the residual liquid and the liquid cartridge should be then exchanged quickly. Consequently, the subsequent processing can be prevented from being continuously carried out carelessly for a long period of time. Thus, it is possible to reliably prevent a drawback from being caused by idle ejecting on the apparatus side due to the continuous use in a state in which the amount of the residual liquid in the liquid cartridge is completely nulled.

(6). A liquid ejection control method for an apparatus comprising a liquid receiving portion to which a liquid cartridge provided with a liquid chamber and a liquid sensor is detachably attached, and a liquid ejection head ejecting a liquid supplied from the liquid cartridge as liquid droplets to a medium, the method comprising:

a dot count processing of counting and calculating the number of the liquid droplets ejected from the liquid ejection head after attaching the liquid cartridge to the liquid receiving portion to obtain a count value;

a dot count judgment processing of judging whether the count value reaches a predetermined value;

a liquid presence judgment processing of judging a presence or absence of the liquid stored in the liquid chamber by the liquid sensor in a predetermined interval;

a dot count correction processing of modifying, when it is judged that the count value does not reach the predetermined value in the dot count judgment processing and the absence of the liquid is judged in the liquid presence judgment processing, the count value at a present time to a previous count value of when the presence of the liquid has judged immediately before judging the absence of the liquid and, of adding, to the previous count value, a additional count value obtained from when the presence of the liquid has judged to the present time to correct the previous count value; and an ejection stop processing of stopping ejecting the liquid droplets when it is judged that the corrected count value reaches the predetermined value in the dot count judging processing.

According to the liquid ejection control method described above, the count value of the dot count processing which is obtained by counting and calculating the quantity of droplets is corrected in the dot count correction processing.

Also in the case in which there is an error of the dot count processing based on a cumulative count after the attachment of the liquid cartridge to the liquid receiving portion, a variation in the ejection amount of the liquid ejection head or a variation in the volume of the liquid chamber and the amount of the liquid which is accommodated, it is possible to enhance precision in the count value for judging whether the predetermined value (for example, the effective liquid amount of the liquid cartridge) is reached or not in the dot count judgment processing. Thus, it is possible to reduce a margin for the detection of the residual amount.

(7). A liquid ejection control method for an apparatus comprising a liquid receiving portion to which a liquid cartridge provided with a liquid chamber and a liquid sensor is detachably attached, and a liquid ejection head ejecting liquid droplets supplied from the liquid cartridge as liquid drop lets to a medium, the method comprising;

a dot count processing of counting and calculating the number of the liquid droplets ejected from the liquid ejection head after attaching the liquid cartridge to the liquid receiving portion to obtain a count value;

a first dot count judgment processing of judging whether the count value reaches a first value;

a liquid presence judgment processing of judging a presence or absence of the liquid stored in the liquid chamber by the liquid sensor in a predetermined interval;

a second dot count judgment processing of judging, when it is judged that the count value does not reach the first value in the first dot count judgment processing and the absence of the liquid is judged in the liquid presence judgment processing, whether the count value reaches a second value; and an ejection stop processing of stopping ejecting the liquid droplets when it is judged that the count value reaches the first value in the first dot count judgment processing or the second value in the second dot count judgment processing.

According to the liquid ejection control method described above, the liquid ejection is stopped when it is judged, in the second dot count judgment, that the dot count value counted and calculated after the absence of the liquid is judged reaches the second value.

Consequently, a dot count value corresponding to an amount of storage of the liquid in a buffer chamber provided at the downstream of the liquid sensor is preset to the second value, and after the absence of the liquid is judged, the liquid ejection processing is executed by the apparatus within an allowable range of the liquid storage amount in the buffer chamber, and the liquid cartridge is then exchanged. Therefore, the amount of the liquid remaining in the liquid cartridge to be discarded due to the exchange can be minimized because the liquid in the buffer chamber has already been consumed almost perfectly.

(8). A liquid ejection apparatus to which a liquid cartridge comprising a liquid chamber and a liquid sensor is detachably attached, the apparatus comprising:

a liquid ejection head, ejecting a liquid supplied from the liquid chamber as liquid droplets to a medium;

a dot counter, counting the number of the liquid droplets ejected from the liquid ejection head to obtain a count value, a detector, detecting a signal from the liquid sensor to judge a presence or absence of the liquid stored in the liquid chamber; and a controller, controlling the liquid ejection head to stop ejecting the liquid droplets based on the count value obtained by the dot counter and the signal detected by the detector.

According to the liquid ejection apparatus, since the controller controls the liquid ejection head to stop ejecting based on the count value by the dot counter and the signal detected by the detector, it is possible to enhance a precision of judging the ink end.

(9). A liquid ejection control method for an apparatus which is provided with a liquid ejection head for ejecting liquid droplets to a medium, and to which a liquid cartridge is detachably attached, the liquid cartridge comprising:

a liquid chamber, storing a liquid therein;

a liquid supplying port, supplying the liquid to the liquid ejection head;

a liquid passage, through which the liquid chamber and the liquid supplying port communicate with each other;

a liquid sensor, forming a part of the liquid passage and detecting a presence or absence of the liquid in the liquid chamber; and a buffer chamber, storing the liquid therein and communicating with the liquid passage at a downstream of the liquid sensor, the method comprising:

detecting a signal output from the liquid sensor;

judging the presence or absence of the liquid stored in the liquid chamber from the signal; and counting and calculating the number of the liquid droplets ejected from the liquid ejection head at least after the absence of the liquid is judged.

According to the liquid ejection control method, since the number of the liquid droplets is counted and calculated at least after the absence of the liquid is judged by the liquid sensor, it is possible to enhance a precision of judging the ink, end.

According to the liquid cartridge, the liquid ejection apparatus and the liquid ejecting control method of the invention, when the absence of the residual liquid is detected by the liquid end sensor, the amount of the liquid remaining in the buffer chamber is clear. Therefore, a subsequent processing can be prevented from being continuously carried out carelessly for a long period of time. Consequently, it is possible to reliably prevent a drawback from being caused by idle ejection on the apparatus side due to the continuous use in a state in which the amount of the residual liquid in the liquid cartridge is completely nulled.

Also in the case in which there is an error of the dot count processing based on a cumulative count after the attachment of the liquid cartridge to the liquid receiving portion, a variation in the amount of ejection of the liquid ejection head or a variation in the capacity of the liquid chamber and the amount of the liquid which is accommodated, moreover, it is possible to enhance precision in the count value for judging whether the effective liquid amount of the liquid cartridge is reached or not in the dot count judgment processing. Thus, it is possible to reduce a margin for the detection of the residual amount.

Also, a dot count value corresponding to an amount of storage of the liquid in the buffer chamber is preset to the predetermined dot value, and after the absence of the liquid is judged, the liquid ejection processing is executed by the apparatus within an allowable range of the amount of storage of the liquid in the buffer chamber, and the liquid cartridge is then exchanged. Therefore, the amount of the liquid remaining in the liquid cartridge to be discarded due to the exchange can be minimized because the liquid in the buffer chamber has already been consumed almost perfectly.

Accordingly, it is possible to provide a liquid cartridge, a liquid ejection apparatus and a liquid ejecting control method which can minimize an amount of a liquid remaining in the liquid cartridge, and furthermore, can reliably prevent a drawback from being caused by idle hitting on an apparatus side.

DETAILED DESCRIPTION OF THE INVENTION

A liquid cartridge according to an embodiment of the invention will be described below in detail with reference to the accompanying drawings.

Figure 1:
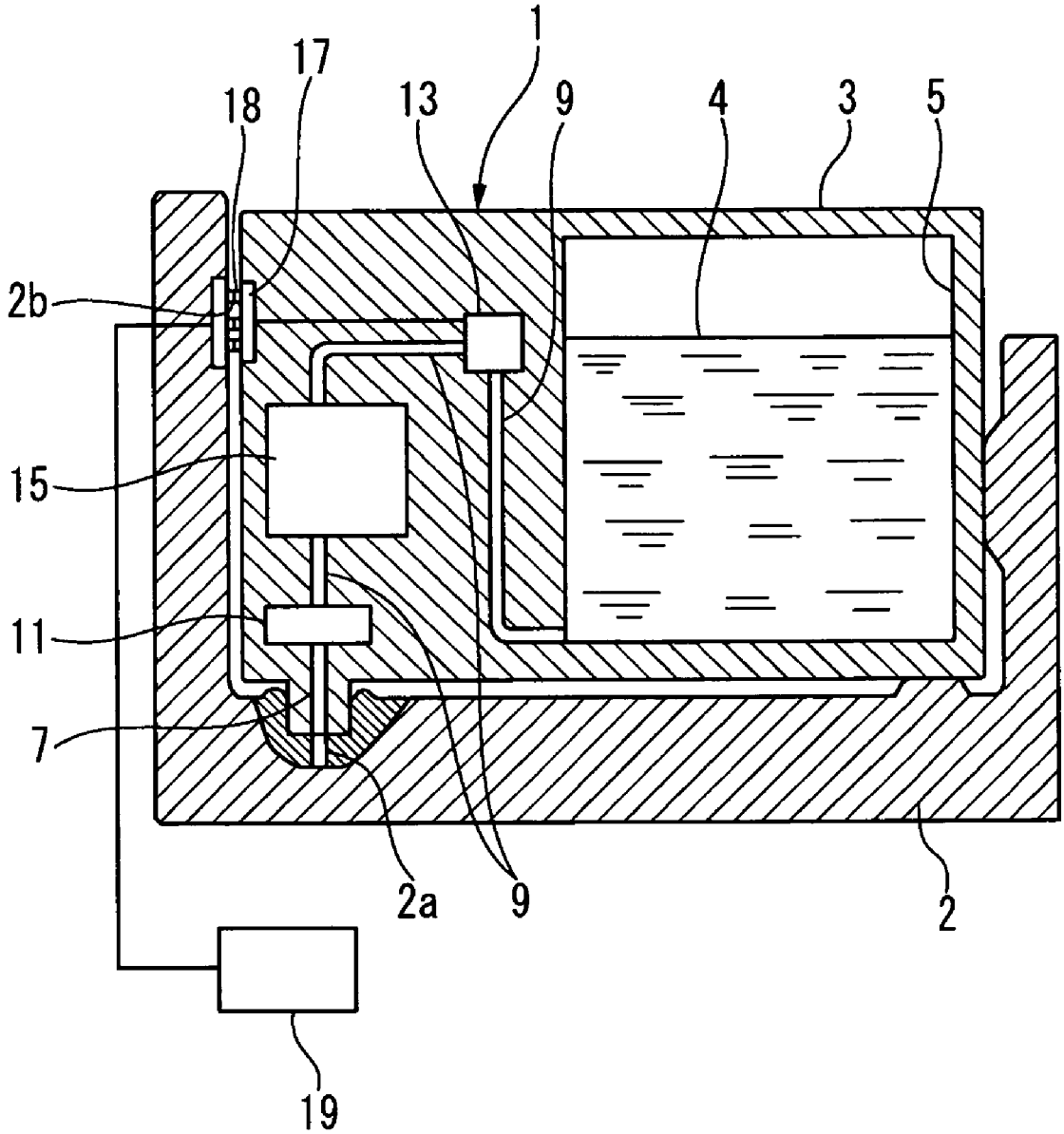
FIG. 1 is a sectional view showing a schematic structure of a liquid cartridge according to an embodiment of the invention.
Figure 2:
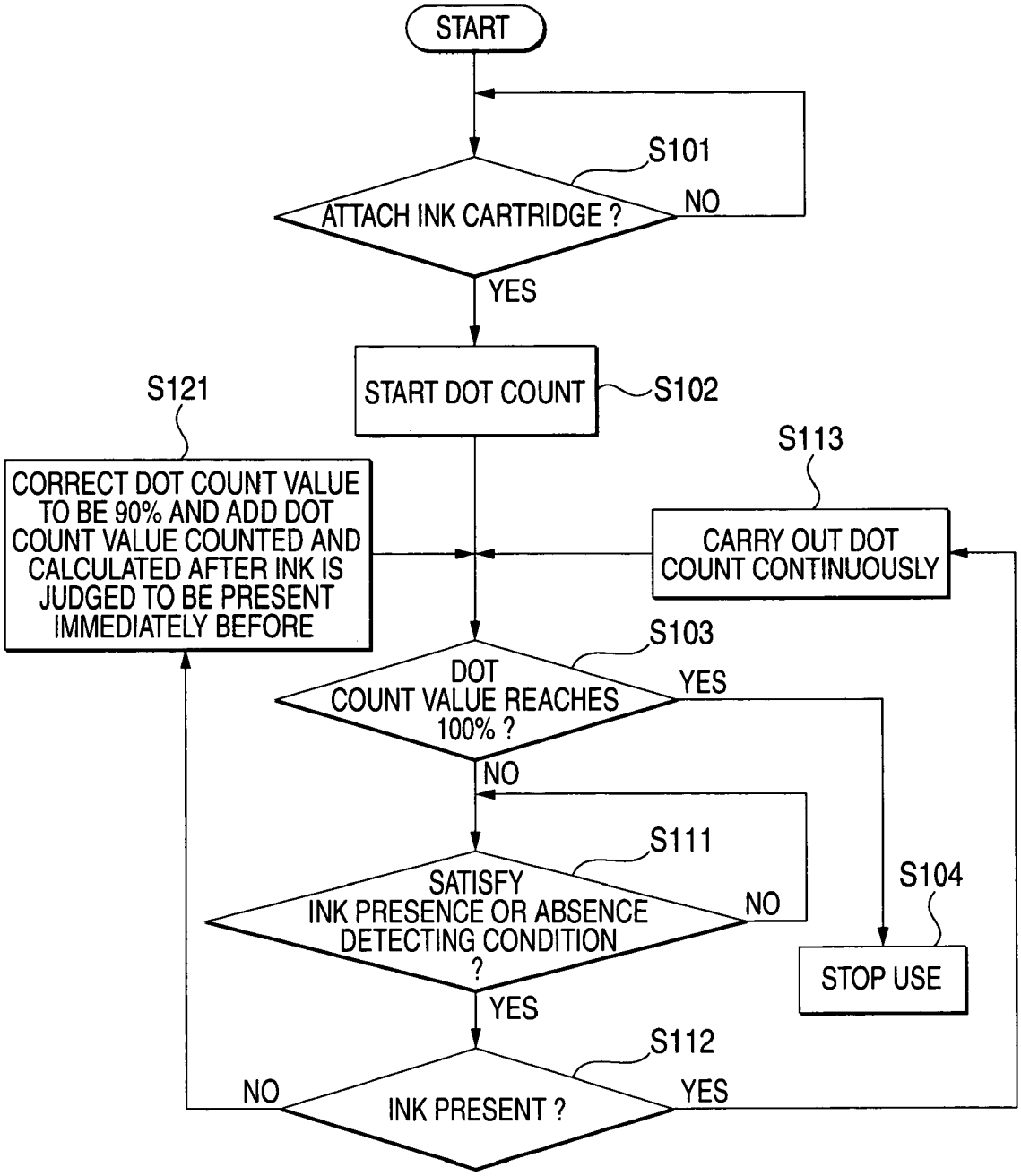
FIG. 2 is a flowchart showing an ink liquid ejection control method in an ink jet printer mounting the liquid cartridge illustrated in FIG. 1.
Figure 3:
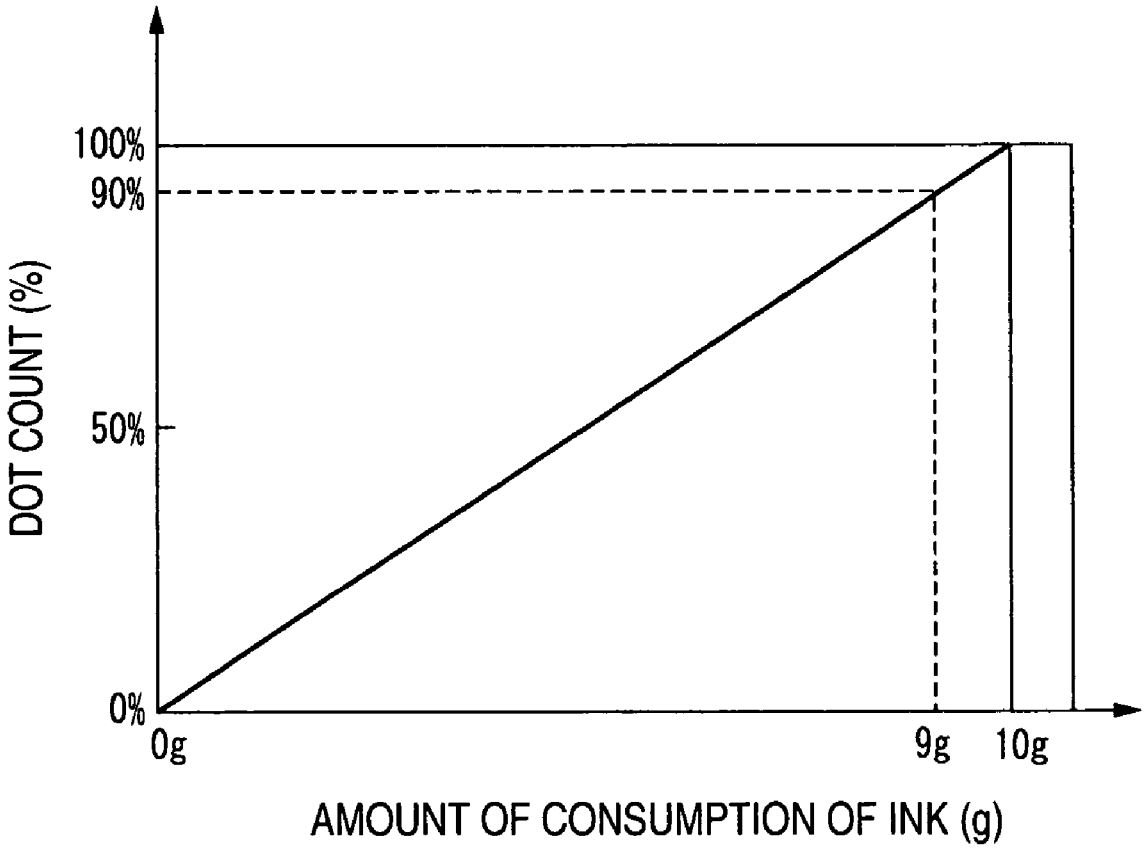
FIG. 3 is a graph showing a relationship between a dot count value and an ink consumption amount in the ink liquid ejection control method illustrated in FIG. 2.

FIG. 1 is a sectional view showing a schematic structure of the liquid cartridge according to the embodiment of the invention, FIG. 2 is a flowchart showing an ink liquid ejection control method in an ink jet printer mounting the liquid cartridge illustrated in FIG. 1, and FIG. 3 is a graph showing a relationship between a dot count value and an amount of consumption of an ink in the ink liquid ejection control method illustrated in FIG. 2.

As shown in FIG. 1, an ink cartridge (a liquid cartridge) 1 according to the embodiment is of an atmosphere communication type comprising, in a container body 3 to be attached to a cartridge attachment portion 2 of an ink jet printer (apparatus), an ink chamber (a liquid chamber) 5 for accommodating an ink liquid 4, a liquid supply port 7 to be connected to an ink liquid receiving portion (a liquid receiving portion) 2*a* of the cartridge attachment portion 2, a liquid passage 9 for causing the ink chamber 5 to communicate with the liquid supply port 7, an atmosphere communication opening (not shown) for introducing outside air into the ink chamber 5 with a consumption of the ink liquid 4 in the ink chamber 5, pressure regulating means (negative pressure generating means) 11 provided in the middle of the liquid passage 9 and serving to regulate a pressure of an ink liquid to be supplied to the ink liquid receiving portion 2*a* through the liquid supply port 7 so as to be a predetermined pressure, and an ink end sensor (a liquid sensor) 13 provided in the middle of the liquid passage 9 on an upstream side of the pressure regulating means 11 and serving to detect the presence of the ink liquid 4 in the ink chamber 5.

The cartridge attachment portion 2 is provided in a carriage (not shown) mounting a printing head (a liquid ejection head) for ejecting an ink liquid onto a paper (a medium) and disposed to be reciprocable in an orthogonal direction to a direction of delivery of the paper, for example.

In the embodiment, the ink end sensor 13 is ink liquid presence or absence detecting means for generating an oscillation by a piezoelectric vibrator and detecting a presence or absence of the ink liquid based on a residual oscillation changed depending on whether the ink liquid or the air is present in the liquid passage 9. The ink end sensor 13 detects that the ink liquid is not present in the case in which the ink liquid in the ink chamber 5 is completely consumed and the air introduced from the atmosphere communication opening into the ink chamber 5 enters the liquid passage 9, and outputs a signal indicative of no ink liquid.

In case of the ink cartridge 1 according to the embodiment, a buffer chamber 15 storing the ink liquid 4 to be supplied to the liquid supply port 7 through the pressure regulating means 11 and capable of supplying the ink liquid in a constant amount after the ink end sensor 13 detects no ink liquid is provided on the liquid passage 9 between the ink end sensor 13 and the pressure regulating means 11.

Furthermore, an amount of storage of the ink liquid (an amount of storage of liquid storage) in the buffer chamber 15 including the capacity of the liquid passage 9 between the ink end sensor 13 and the pressure regulating means 11 according to the embodiment is set to be substantially 10% of an effective ink liquid amount (an effective liquid amount) to be accommodated in the ink cartridge 1. That is, the capacity of the buffer chamber may include the capacity of the liquid passage between the ink end sensor 13 and the pressure regulating means 11. The effective liquid amount of the ink cartridge 1 indicates an amount of storage of the liquid to be accommodated in at least the ink chamber 5 and the buffer chamber 15.

More specifically, in the case in which the effective ink liquid amount in the ink liquid to be accommodated in the ink cartridge 1 is substantially 10 grams, the amount of storage 6 of the ink liquid in the buffer chamber 15 is substantially 1 gram.

When substantially 90% of the effective ink liquid amount is consumed, moreover, a control circuit 19 on the ink jet printer side judges that an ink low state in which the amount of the residual ink liquid in the ink chamber 5 is small is brought.

Moreover, the ink cartridge 1 according to the embodiment is provided with a memory circuit 17 for storing information about the amount of the residual ink liquid 4. The memory circuit 17 is connected to a connecting terminal 18 on an external surface of the container body 3. Moreover, the ink end sensor 13 is also connected to the connecting terminal 18.

When the ink cartridge 1 is attached to the cartridge attachment portion 2, the connecting terminal 18 is electrically connected to a connecting terminal 2*b* on the cartridge attachment portion 2 side and the ink end sensor 13 and the memory circuit 17 are connected to the control circuit 19 on the printer side through the connecting terminals 2*b* and 18.

The control circuit 19 executes a dot count processing of counting and calculating the quantity of the droplets of the ink liquid 4 ejected from a nozzle of the printing head in the printing processing of the ink jet printer, executes a maintenance processing such as cleaning corresponding to an operating situation of the ink jet printer or detects the presence of the ink liquid 4 in the ink chamber 5 from a signal output from the ink end sensor 13 and finally gives an instruction for stopping the printing and exchanging the ink cartridge 1 based on a dot count value of the droplets of the ink liquid 4 which is counted and calculated.

Furthermore, the control circuit 19 according to the embodiment controls a processing of ejecting the ink liquid 4 in the ink jet printer corresponding to the amount of the residual ink liquid in the ink cartridge 1.

More specifically, the control circuit 19 controls the processing of ejecting the ink liquid 4 by the ink liquid ejection control method shown in FIG. 2.

First of all, it is judged whether the ink cartridge 1 is attached to the cartridge attachment portion 2 or not (Step S101). If it is judged that the ink cartridge 1 is attached, a dot count processing of counting and calculating the quantity of the droplets of the ink liquid 4 ejected from the printing head in the printing processing is started (Step S102).

Subsequently, there is executed a dot count judgment processing of judging whether or not a count value obtained by the dot count processing reaches the effective ink liquid amount of the ink cartridge 1 which is preset (Step S103).

If it is judged that the dot count value reaches 100% (a ratio to the effective ink liquid amount) at the Step S103, the processing proceeds to Step S104 in which the use of the ink cartridge 1 is stopped as an ink end.

If it is judged that the dot count value is smaller than 100% at the Step S103, the processing proceeds to next Step S111.

At the Step S111, it is judged whether an ink presence or absence detecting condition for detecting the presence or absence of the ink liquid is satisfied or not based on the signal output from the ink end sensor 13. The condition for detecting the presence or absence of the ink is that a timing of a paper feed/discharge, a pause for a print job or a start of a cleaning processing is given or not, for example. By judging whether it is in a preset timing, it is judged whether the ink presence or absence detecting condition to be a requirement for executing the detection is satisfied or not.

If it is judged that the ink presence or absence detecting condition is satisfied at the Step S111, the processing proceeds to next Step S112 in which the presence or absence of the ink liquid is detected by the ink end sensor 13 (an ink liquid presence judgment processing).

If it is judged that the ink liquid is present at the Step S112, the past dots are counted continuously (Step S113) and the processing returns to the Step S103.

On the other hand, if it is judged that the ink is not present at the Step S112, the processing proceeds to Step S121.

At the Step S121, it is judged that the state of ink low is brought when it is judged that the ink liquid is present immediately before, and there is executed a dot count correction processing of correcting the dot count value obtained when it is judged that the ink liquid is present immediately before into a predetermined dot count value (for example, 90%) which is preset, and furthermore, of adding the dot count values calculated from the time that the ink liquid is judged to be present immediately before to a current time to the predetermined dot count value thus corrected. And then the processing returns to the Step S103.

The ink liquid 4 is also consumed by the maintenance processing such as the cleaning in addition to the printing processing which is subjected to the dot counting. In addition, the number of executions of the maintenance processing such as the cleaning is changed depending on a situation of the use of the printer by a user.

When the dot count value reaches 100% in a situation of an application in which an average cleaning processing is executed, therefore, the dot count value of 100% to be the effective ink liquid amount is selected in such a manner that the effective ink liquid amount of the ink cartridge 1 is consumed by substantially 10 grams as shown in FIG. 3.

According to the ink cartridge 1 in accordance with the embodiment, it is apparent that the ink liquid 4 corresponding to substantially 10% of the effective ink liquid amount in the ink cartridge 1 remains in the buffer chamber 15 provided on the liquid passage 9 at a downstream of the ink end sensor 13 when it is detected, by the ink end sensor 13, that the ink liquid is not left.

If the printing processing of the ink jet printer is executed within an allowable range corresponding to substantially 10% of the effective ink liquid amount of the ink cartridge 1 and the ink cartridge 1 is then exchanged after it is detected, by the ink end sensor 13, that the ink liquid is not left, therefore, the amount of the ink liquid remaining in the ink cartridge 1 to be discharged by the exchange can be minimized because the ink liquid 4 in the buffer chamber 5 has been consumed almost completely.

When it is detected, by the ink end sensor 13, that the ink liquid is not left, moreover, the amount of the ink liquid left in the buffer chamber 5 is clear. Therefore, a subsequent printing processing is not continuously carried out carelessly for a long period of time. Consequently, it is possible to reliably prevent a drawback from being caused by idle ejecting on the ink jet printer side due to the continuous use in a state in which the amount of the residual ink liquid in the ink cartridge 1 is nulled completely.

According to the ink liquid ejection control method shown in FIG. 2, moreover, the count value of the dot count processing which is obtained by counting and calculating the quantity of the droplets of the ink liquid 4 is corrected by the dot count correction processing at the Step S121.

Also in the case in which there is an error of the dot count processing which is made by cumulative counting after the attachment of the ink cartridge 1 to the ink liquid receiving portion 2*a* of the cartridge attachment portion 2, a variation in the amount of ejection of the printing head or a variation in the volume of the ink chamber 5 or the amount of the ink liquid which is accommodated, therefore, it is possible to enhance precision in the count value with which it is judged whether or not the effective ink liquid amount of the ink cartridge 1 is reached in the dot count judgment processing at the Step S103. Thus, it is possible to reduce a margin for the detection of the residual amount.

If the effective ink liquid amount to be used in the dot count judgment processing is set to be a mean dot count value in the consumption in a general application state, and furthermore, the amount of storage of the ink liquid in the buffer chamber 15 of the ink cartridge 1 is set to be substantially 10% of the effective ink liquid amount as described above, for example, it is possible to prevent the generation of the idle ejecting also in the case in which an exchange in progress, that is, a removal of the ink cartridge 1 from the ink jet printer in the middle of use or a reattachment is repeated.

Figure 4:
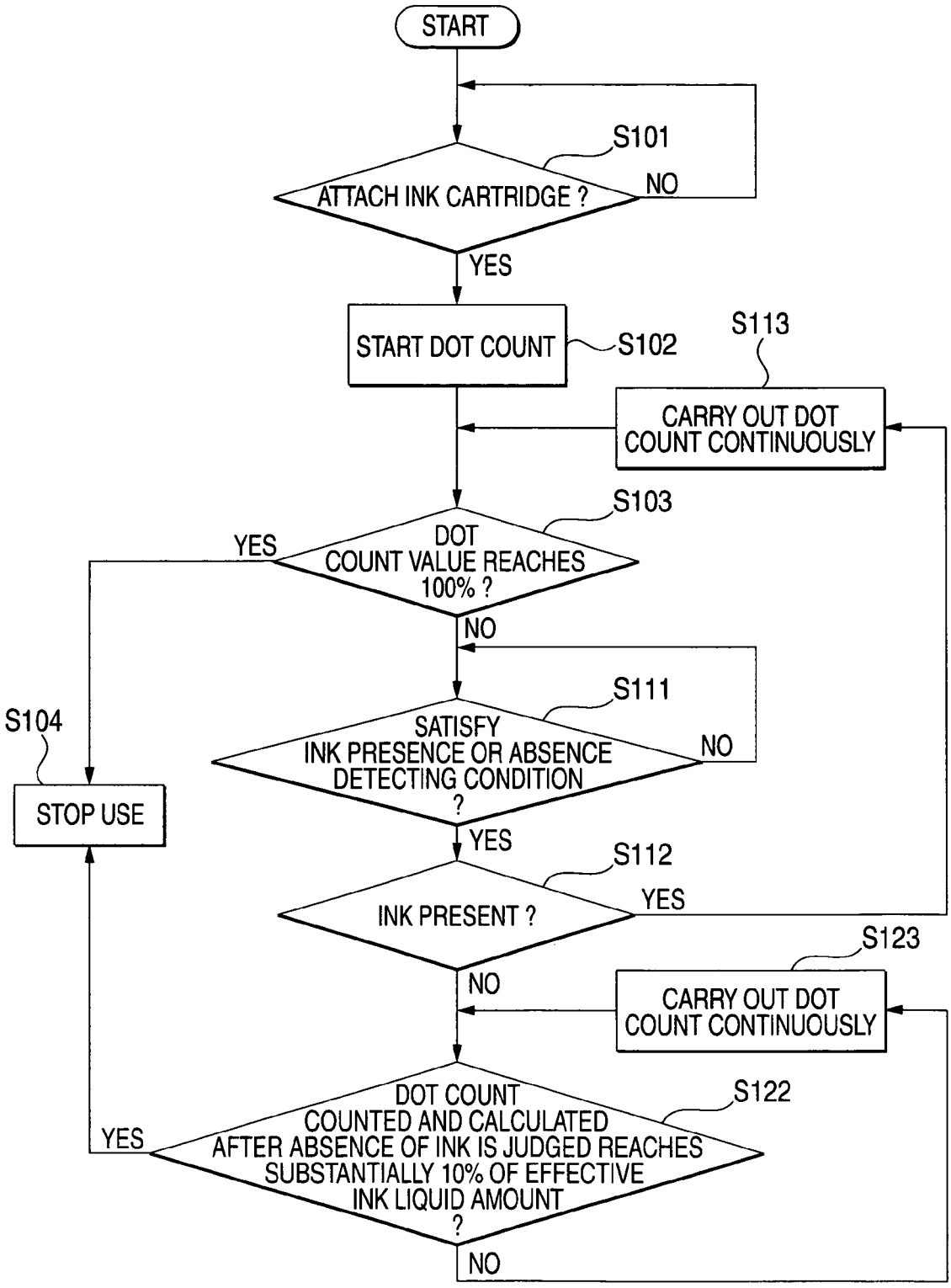
FIG. 4 is a flow chart showing another ink liquid ejection control method in an ink jet printer mounting the liquid cartridge illustrated in FIG. 1.

FIG. 4 is a flow chart showing another ink liquid ejection control method in an inkjet printer mounting the liquid cartridge illustrated in FIG. 1. That is, the control circuit on the ink jet printer side of the invention can control the processing of ejecting the ink liquid 4 by the liquid ejection control method shown in FIG. 4.

First of all, it is judged whether the ink cartridge 1 is attached to the cartridge attachment portion 2 or not (Step S101). If it is judged that the ink cartridge 1 is attached, a dot count processing of counting and calculating the quantity of the droplets of the ink liquid 4 ejected from the printing head in the printing processing is started (Step S102).

Subsequently, there is executed a dot count judgment processing of judging whether or not a count value obtained by the dot count processing reaches the effective ink liquid amount of the ink cartridge 1 which is preset (Step S103).

If it is judged that the dot count value reaches 100% (a ratio to the effective ink liquid amount) at the Step S103, the processing proceeds to Step S104 in which the use of the ink cartridge 1 is stopped as an ink end.

If it is judged that the dot count value is smaller than 100% at the Step S103, the processing proceeds to next Step S111.

At the Step S111, it is judged whether an ink presence or absence detecting condition for detecting the presence or absence of the ink liquid is satisfied or not based on the signal output from the ink end sensor 13. The condition for detecting the presence or absence of the ink is that a timing of a paper feed/discharge, a pause for a print job or a start of a cleaning processing is given or not, for example. By judging whether it is in a preset timing, it is judged whether the ink presence or absence detecting condition to be a requirement for executing the detection is satisfied or not.

If it is judged that the ink presence or absence detecting condition is satisfied at the Step S111, the processing proceeds to next Step S112 in which the presence or absence of the ink liquid is detected by the ink end sensor 13 (an ink liquid presence judgment processing).

If it is judged that the ink liquid is present at the Step S112, the past dots are counted continuously (Step S113) and the processing returns to the Step S103.

On the other hand, if it is judged that the ink is not present at the Step S112, the processing proceeds to Step S122.

At the step S122, there is executed a predetermined dot count judgment processing of judging whether the dot count value counted and calculated after the absence of the ink liquid is judged reaches a predetermined dot count value (a dot count value corresponding to an amount of storage of the ink liquid in the buffer chamber) or not.

If it is judged that the dot count value after the absence of the ink liquid is judged reaches a predetermined dot count value (for example, 10% of the effective ink liquid amount), the processing proceeds to step S104 in which the use of the ink cartridge 1 is stopped as an ink end.

On the other hand, If it is judged that the dot count value after the absence of the ink liquid is judged does not reach a predetermined dot count value, the past dots are counted continuously (Step S123) and the processing returns to the Step S122.

According to the ink ejection control method as shown in FIG. 4, it is judged in the predetermined dot count judgment processing whether the dot count after the absence of the ink liquid is judged reaches the predetermined dot count value (for example, 10% of the effective ink liquid amount) which is preset, if the dot count reaches the predetermined dot count value, the use of the ink cartridge 1 is stopped as an ink end.

Consequently, a dot count value corresponding to an amount of storage of the ink liquid in the buffer chamber 15 is preset to the predetermined dot value, and after the absence of the ink liquid is judged, the liquid ejection processing is executed by the ink jet printer within an allowable range of the amount of storage of the ink liquid in the buffer chamber corresponding to 10% of the effective ink liquid amount of the ink cartridge 1, and the liquid cartridge is then exchanged. Therefore, the amount of the ink liquid remaining in the liquid cartridge to be discarded due to the exchange can be minimized because the ink liquid 4 in the buffer chamber 15 has already been consumed almost perfectly.

Also, If the effective ink liquid amount to be used in the dot count judgment processing is set to be a mean dot count value in the consumption in a general application state, and furthermore, the amount of storage of the ink liquid in the buffer chamber 15 of the ink cartridge 1 is set to be substantially 10% of the effective ink liquid amount as described above, for example, it is possible to prevent the generation of the idle ejecting also in the case in which an exchange in progress, that is, a removal of the ink cartridge 1 from the ink jet printer in the middle of use or a reattachment is repeated.

The amount of storage of the ink liquid in the buffer chamber 15 is not restricted to substantially 10% of the effective amount of the ink liquid to be accommodated in the ink cartridge 1 described in the embodiment.

For example, the amount of storage of the ink liquid in the buffer chamber 15 can also be set corresponding to a standard use amount (a printing amount for one page) in the printing operation of the ink jet printer over one paper.

In case of the ink cartridge 1 in which the amount of storage of the ink liquid in the buffer chamber 15 is set, thus, it is apparent that the ink liquid 4 capable of carrying out the printing operation for one page still remains in the buffer chamber 15 provided on the liquid passage 9 at the downstream side of the ink end sensor 13 when it is detected, by the ink end sensor 13, that the ink liquid is not left.

Also after it is detected, by the ink end sensor 13, that the ink liquid is not left, therefore, the ink jet printer can reliably complete the printing processing for one page. Consequently, it is possible to prevent the ink liquid 4 from being gone in the middle of the printing processing to cause the page to be wasted due to the incomplete end of the printing processing over the page.

By executing the printing processing corresponding to one page and then exchanging the ink cartridge 1 after it is detected, by the ink end sensor 13, that the ink liquid is not left, moreover, it is possible to minimize the amount of the ink liquid remaining in the ink cartridge 1 to be discarded by the exchange because the ink liquid 4 in the buffer chamber 15 has already been consumed almost completely.

When it is detected, by the ink end sensor 13, that the ink liquid is not left, furthermore, it is clear that the ink liquid 4 corresponding to the printing processing for one page remains in the buffer chamber 15. Therefore, the subsequent printing processing can be prevented from being continuously carried out carelessly for a long period of time. Thus, it is possible to reliably prevent a drawback from being caused by the idle ejecting on the ink jet printer side due to the continuous use in a state in which the amount of the residual ink liquid in the ink cartridge 1 is nulled completely.

Moreover, the amount of storage of the ink liquid in the buffer chamber 15 can also be set to be a capacity corresponding to a maximum value of the amount of consumption of the ink liquid to be consumed in the maintenance processing such as the cleaning (a liquid consumption amount) by the ink jet printer.

For example, the cleaning processing is set to have three levels and the amount of the ink liquid to be consumed on each of the levels is varied.

If the amount of storage of the ink liquid in the buffer chamber 15 is set corresponding to the cleaning processing on a level "3" in which the amount of consumption of the ink liquid has a maximum value, therefore, it is apparent that the ink liquid 4 which can be subjected to the execution of the cleaning processing on the level "3" remains in the buffer chamber 15 when it is detected, by the ink end sensor 13, that the ink liquid is not left. Accordingly, it is possible to reliably execute the cleaning processing on the level "3" in which the amount of consumption of the ink liquid has the maximum value until it is detected, by the ink end sensor 13, that the ink liquid is not left.

When it is detected, by the ink end sensor 13, that the ink liquid is not left, for example, the amount of the ink liquid left in the buffer chamber 15 is clear. In the case in which the cleaning processing is not executed, therefore, it is preferable that the ink cartridge 1 should be exchanged quickly after the residual ink liquid is consumed by the application of the printing processing corresponding to the amount of the residual ink liquid in place thereof. The subsequent printing processing can be prevented from being continuously carried out carelessly for a long period of time. Thus, it is possible to reliably prevent a drawback from being caused by the idle ejecting on the ink jet printer side due to the continuous use in a state in which the amount of the residual ink liquid in the ink cartridge 1 is nulled completely.

Furthermore, the amount of storage of the ink liquid in the buffer chamber 15 can also be set corresponding to an initial filling amount of the ink liquid 4 to be filled in the passage from the ink cartridge 1 to the printing head by the ink jet printer when the ink cartridge 1 is attached to the cartridge attachment portion 2 of the ink jet printer.

According to the ink cartridge 1 in which the amount of storage of the ink liquid in the buffer chamber 15 is set, thus, it is apparent that the ink liquid 4 corresponding to the amount of initial filling in the attachment to the ink jet printer remains in the buffer chamber 15 provided on the liquid passage 9 at the downstream side of the ink end sensor 13 when the absence of the residual ink liquid is detected by the ink end sensor 13.

In a state in which the absence of the residual ink liquid is not detected by the ink end sensor 13 when the ink cartridge 1 is to be once removed from the ink jet printer in the middle of the use, accordingly, the amount of the residual ink liquid in the ink cartridge 1 can be prevented from being completely nulled so that the initial filling can be executed safely, and at the same time, the generation of the idle ejecting can be prevented even if the initial filling is executed when the ink cartridge 1 is attached to the cartridge attachment portion 2 of the ink jet printer again.

When the absence of the residual ink liquid is detected by the ink end sensor 13, moreover, the amount of the ink liquid remaining in the buffer chamber 15 is clear. In the case in which the initial filling is not carried out, therefore, it is preferable that the ink cartridge 1 should be exchanged quickly after the residual ink liquid is alternatively consumed by the employment of a normal processing corresponding to the initial filling amount. Consequently, the subsequent printing processing can be prevented from being continuously carried out carelessly for a long period of time. Thus, it is possible to reliably prevent a drawback from being caused by the idle ejecting on the ink jet printer side due to the continuous use in a state in which the amount of the residual ink liquid in the ink cartridge 1 is completely nulled.

Moreover, the amount of storage of the ink liquid in the buffer chamber 15 can also be set corresponding to the amount of the residual ink liquid in the ink cartridge 1 (the amount of the residual liquid) to be a reference for prohibiting the maintenance processing such as the cleaning by the ink jet printer.

In the ink cartridge 1 in which the amount of storage of the ink liquid in the buffer chamber 15 is thus set, when the absence of the residual ink liquid is detected by the ink end sensor 13, the amount of the ink liquid remaining in the buffer chamber 15 is clear. In the case in which the maintenance processing such as the cleaning is not executed, therefore, it is preferable that the ink cartridge 1 should be exchanged quickly after the residual ink liquid is alternatively consumed by the employment of the printing processing corresponding to the amount of the residual ink liquid. Consequently, the subsequent printing processing can be prevented from being continuously carried out carelessly for a long period of time. Thus, it is possible to reliably prevent a drawback from being caused by the idle ejecting on the ink jet printer side due to the continuous use in a state in which the amount of the residual ink liquid in the ink cartridge is completely nulled.

It is possible to properly set the amount of storage of the ink liquid in the buffer chamber 15 including the capacity of the liquid passage 9 between the ink end sensor 13 and the pressure regulating means 11 by varying the capacity of the buffer chamber 15 or changing a position in the liquid passage 9 in which the ink end sensor 13 is to be attached, for example.

Moreover, the ink low period determined by the amount of storage of the ink liquid in the buffer chamber 15 is set to be the longest timing at a frequency at which the presence of the ink is detected in the ink liquid presence judgment processing. Consequently, it is possible to prevent the ink cartridge 1 from actually becoming an ink end when the ink end sensor 13 detects the absence of the residual ink liquid.

The structures of the container body, the liquid chamber, the liquid receiving portion, the liquid supply port, the liquid passage, the liquid sensor and the buffer chamber in the liquid cartridge according to the invention are not restricted to the structures according to the embodiment but it is apparent that various configurations can be employed without departing from the scope of the invention.

Moreover, the use of the liquid cartridge according to the invention is not restricted to the ink cartridge 1 to be attached to the ink jet printer which is the apparatus comprising the printing head to be the liquid ejection head as in the embodiment.

For example, the invention can also be applied to a liquid cartridge which is to be attached to a liquid ejection apparatus using a liquid ejection head for discharging a liquid such as a coloring agent ejecting head to be used for manufacturing a color filter of a liquid crystal display, an electrode material ejecting head to be used for forming an electrode of an organic EL display or an FED (a surface emitting display), and furthermore, a bioorganism ejecting head to be used for manufacturing a biochip, and a sample ejecting apparatus to be a precision pipette.

What is claimed is:

1. A liquid cartridge mountable to an apparatus, comprising:

a liquid chamber, having a first capacity to store a liquid therein;

a liquid supplying port, connectable to a liquid receiving portion of the apparatus;

a liquid passage, through which the liquid chamber and the liquid supplying port communicate with each other;

a liquid sensor, forming a part of the liquid passage and detecting a presence or absence of the liquid in the liquid chamber; and a buffer chamber, having a second capacity to store the liquid therein and communicating with the liquid passage at a downstream of the liquid sensor, wherein the second capacity is set to be substantially 10% of an effective liquid amount of the liquid cartridge and wherein the second capacity is set to be smaller than the first capacity.

2. The liquid cartridge according to claim 1, wherein the second capacity is set to be a standard use amount consumed when the apparatus ejects the liquid to one medium.

3. The liquid cartridge according to claim 1, wherein the second capacity is set to be a maximum consumption amount consumed when the apparatus is subjected to a maintenance processing.

4. The liquid cartridge according to claim 1, wherein the second capacity is set to be an initial filling amount for filling the liquid in a passage from the liquid cartridge to a liquid ejection head when the liquid cartridge is attached to the apparatus.

5. The liquid cartridge according to claim 1, wherein the second capacity is set to be a reference amount for prohibiting a maintenance processing.

* * * * *